US009408469B1

(12) United States Patent
Chiu

(10) Patent No.: US 9,408,469 B1
(45) Date of Patent: Aug. 9, 2016

(54) BALL CHAIR

(71) Applicant: Ciber Chiu, Changhua (TW)

(72) Inventor: Ciber Chiu, Changhua (TW)

(73) Assignee: Famosa Corp., Changhua (TW)

( * ) Notice: Subject to any disclaimer, the term of this patent is extended or adjusted under 35 U.S.C. 154(b) by 0 days.

(21) Appl. No.: 14/634,586

(22) Filed: Feb. 27, 2015

(51) Int. Cl.

| | |
|---|---|
| ***A47C 7/02*** | (2006.01) |
| ***A47C 7/40*** | (2006.01) |
| ***A47C 3/00*** | (2006.01) |
| ***A47C 4/02*** | (2006.01) |
| ***A47C 7/00*** | (2006.01) |

(52) U.S. Cl.
CPC ... *A47C 3/00* (2013.01); *A47C 4/02* (2013.01); *A47C 7/006* (2013.01); *A47C 7/02* (2013.01)

(58) Field of Classification Search
CPC ..... A47C 3/00; A47C 4/02; A47C 7/006; A47C 7/02
USPC ..... 297/440.22, 452.41
See application file for complete search history.

(56) References Cited

U.S. PATENT DOCUMENTS 2,999,688 A * 9/1961 Gabrielson ..... A63G 13/08 472/135
4,438,919 A * 3/1984 Gamzo ..... A63B 69/0022 280/87.03
5,145,474 A * 9/1992 Moore ..... A63B 26/003 482/146
5,690,389 A * 11/1997 Ekman ..... A47C 3/16 297/452.41 X
5,833,587 A * 11/1998 Strong ..... A63B 21/154 482/121
6,070,943 A * 6/2000 Guery-Strahm ..... A47C 3/16 297/452.41 X
6,309,331 B1 * 10/2001 Raymond ..... A61H 15/00 482/132
6,390,559 B1 * 5/2002 Schnitzhofer ..... A47C 3/16 297/452.41 X
6,447,070 B1 * 9/2002 Ekman ..... A47C 3/16 297/452.41 X
6,461,284 B1 * 10/2002 Francavilla ..... A61H 1/0218 482/121
6,520,578 B1 * 2/2003 Jospa ..... A61G 15/005 297/452.41 X
6,616,238 B1 * 9/2003 Guery-Strahm ..... A47C 9/002 297/452.41 X
6,702,388 B1 * 3/2004 Chiu ..... A47C 4/54 297/452.41 X
6,702,726 B2 * 3/2004 Lin ..... A63B 21/154 446/220
6,730,005 B1 * 5/2004 Liao ..... A47C 3/16 446/220
6,746,372 B2 * 6/2004 Hsu ..... A47C 9/002 482/123
6,832,817 B1 * 12/2004 Chiu ..... A47C 4/54 16/43
7,140,677 B1 * 11/2006 Chiu ..... A47C 4/54 297/181
7,674,216 B1 * 3/2010 Bolling ..... A63B 23/03516 446/220
7,691,036 B1 * 4/2010 Julian ..... A61H 1/0292 482/110
7,942,796 B2 * 5/2011 Signorile ..... A63B 26/003 482/142
8,056,976 B1 * 11/2011 Polk ..... A47C 3/029 297/452.41 X (Continued)

*Primary Examiner* — Rodney B White
(74) *Attorney, Agent, or Firm* — Che-Yang Chen; Law Office of Scott Warmuth

(57) ABSTRACT

A ball chair may include a chair base and a restricting unit. The chair base has a circular receiving space to receive a ball and an inner portion of the receiving space has a connecting portion that has at least two through holes. The restricting unit has an arc board and a connecting post conjugating with the connecting portion. A restricting board extends from the arc board corresponding to the connecting recessed portion, and the restricting board is protruding from an upper portion of the receiving space. The connecting portion of the chair base is provided for the restricting unit to restrict the ball, and the restricting unit and the connecting portion can be quickly and easily engaged increase the convenience during the assembling process and prevent the ball from being damaged.

6 Claims, 8 Drawing Sheets

(56) References Cited

U.S. PATENT DOCUMENTS 8,079,941 B2 * 12/2011 Nortje ..... A63B 21/00069
482/115
8,235,878 B2 * 8/2012 Signorile ..... A63B 26/003
482/142
8,696,532 B1 * 4/2014 Peterson ..... A63B 69/0057
482/131
8,721,005 B2 * 5/2014 Mankin ..... A47C 4/54
297/452.41 X
8,919,881 B2 * 12/2014 Bay ..... A47C 7/402
297/452.41 X
9,084,909 B1 * 7/2015 Henley ..... A63B 21/00047
9,101,217 B2 * 8/2015 Bay ..... A47C 3/20
2004/0245838 A1 * 12/2004 Chiu ..... A47C 4/54
297/452.41
2005/0261114 A1 * 11/2005 Heitzman ..... A47C 4/54
482/142
2006/0181134 A1 * 8/2006 Douglas ..... A63B 5/00
297/452.41
2008/0176727 A1 * 7/2008 Heitzman ..... A47C 4/54
482/142
2009/0325770 A1 * 12/2009 Baschnagel ..... A63B 21/154
482/142
2010/0314916 A1 * 12/2010 Walser ..... A47C 4/54
297/452.41 X
2012/0299357 A1 * 11/2012 Newman ..... A47C 14/54
297/452.41 X
2014/0210249 A1 * 7/2014 Barnett ..... A47C 9/002
297/452.41 X

* cited by examiner

BALL CHAIR

FIELD OF THE INVENTION

The present invention relates to a ball chair structure, and more particularly to a ball chair that can be quickly and easily assembled.

BACKGROUND OF THE INVENTION

A conventional ball chair is shown in FIGS. 6 and 7. The conventional ball chair is disadvantageous because it may be unstable when the user is sitting thereon and the ball may even fall off the chair, which can cause accident or injury to the user. Thus, the conventional ball chair has been modified to increase the stability of the ball. The modified ball chair may have a connecting portion 32 on top of the through hole 31 of the chair base 30 and a positioning unit 33 is disposed on the connecting portion 32 to further restrict the ball 34 to prevent the ball from falling off.

However, conventional ball chair described above still has some problems: the connecting portion 32 has a plurality of through holes and the positioning unit 33 has a screw 331 corresponding to the connecting portion 32 and is inserted to the connecting portion 32 to engage with a nut 332. Although the positioning unit 33 can be secured on the connecting portion 32, it is difficult for the user to assemble the ball chair. Furthermore, the ball 34 may be damaged by the screw 331.

Moreover, referring to FIG. 8 for another conventional ball chair 40, which has a positioning unit 41 and the positioning unit 41 cannot be removed from the ball chair 40, so the size of the ball chair increases, which may increase the costs for transportation and increase the usage of the packaging materials.

Therefore, there remains a need for a new and improved design for a ball chair to overcome the problems presented above.

SUMMARY OF THE INVENTION

The present invention provides a ball chair including a chair base and a restricting unit. The chair base has a circular receiving space to receive a ball. One inner side of the receiving space has a connecting portion and a seatback is disposed on the chair base facing the connecting portion. The connecting portion at least has two through holes, and an inner wall of each of the through hole expands to form a recessed portion, and an engaging groove is formed between two through holes. A connecting recessed portion is formed above the connecting portion and a restricting hole is formed on both sides of the connecting recessed portion and the connecting recessed portion has a connecting groove. The chair base at least has three legs at a bottom thereof and each leg has a wheel. The restricting unit has an arc board and a connecting post conjugating with the connecting portion. The connecting post has a plurality of slots and a protruding unit. A plurality vertical reinforced ribs are formed at an inner portion of the arc board, a restricting board extends from the arc board corresponding to the connecting recessed portion, and a bottom portion of the restricting board has a restricting rib on both sides thereof. The restricting unit has an engaging rib and a connecting rib located at a bottom portion of the arc board and the restricting board respectively corresponding to the engaging groove and the connecting groove.

Comparing with conventional ball chairs, the present invention is advantageous because: (i) the connecting portion of the chair base is provided for the restricting unit to restrict the ball, and the restricting unit and the connecting portion can be quickly and easily engaged to increase the convenience during the assembling process and prevent the ball from being damaged; (ii) when the restricting unit is attached to the chair base, the arc board is attached and aligned with the inner wall of the receiving space, so when the ball is inserted into the receiving space, the ball can be smoothly attached to the inner wall of the receiving space and can be used to push the arc board of the restricting unit to restrict the restricting unit on the chair base to increase the stability of the ball on the chair base, and further increase the safety of the ball chair; and (iii) the restricting unit and the chair base are connected through engagement, so they can be disassembled into smaller pieces which can be easily transported and the transportation costs can be reduced.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
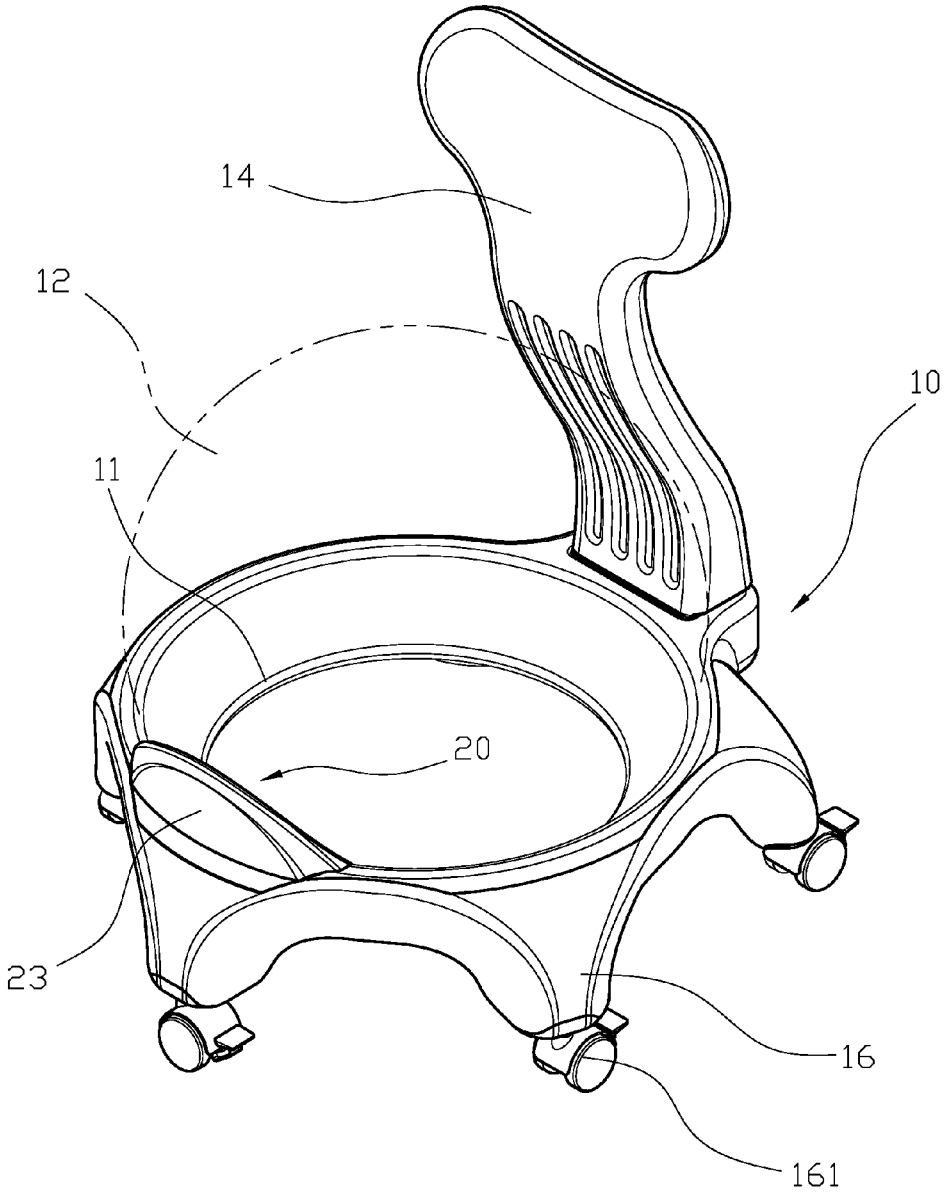
FIG. 1 is a three-dimensional view of the ball chair in the present invention.
Figure 2:
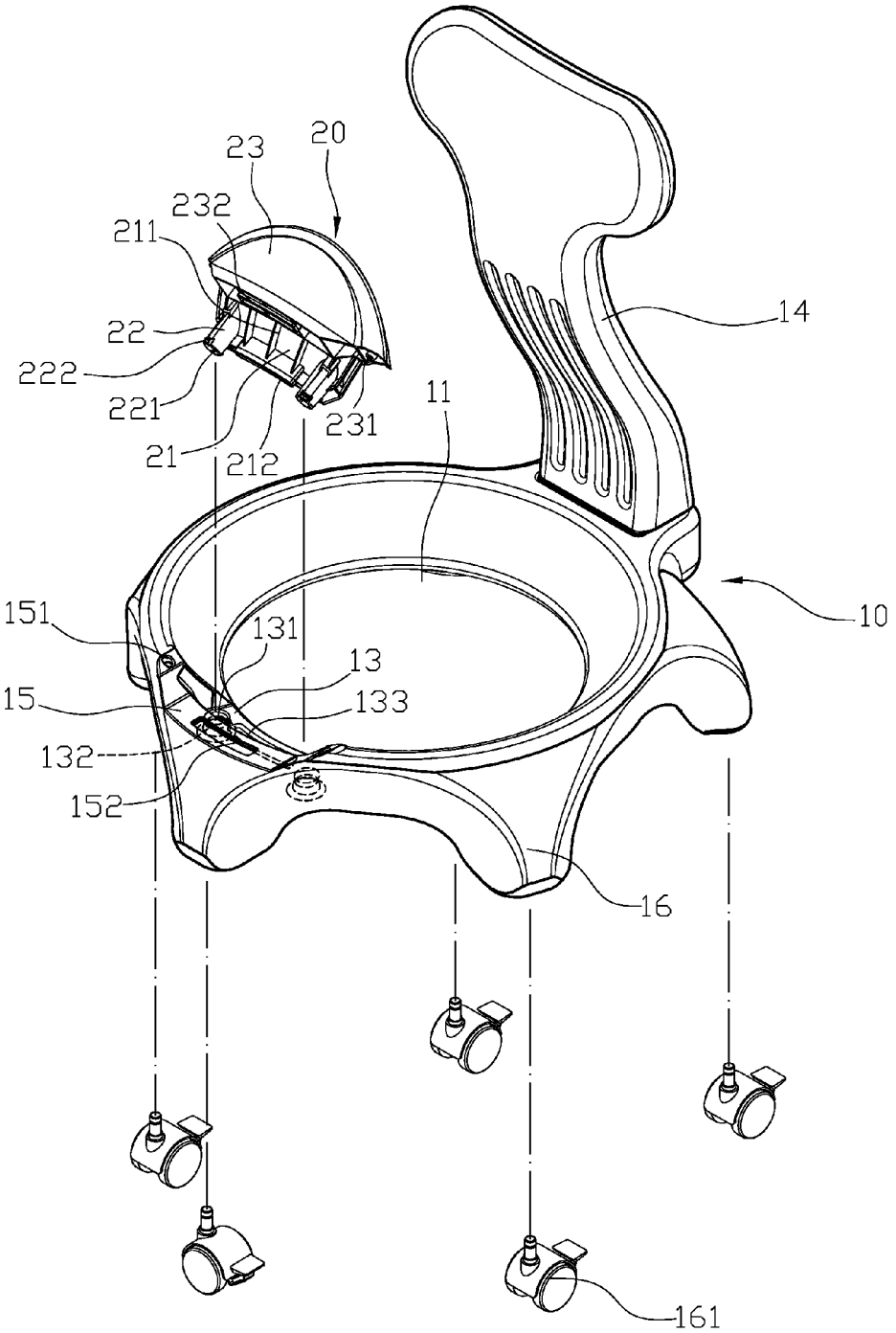
FIG. 2 is an exploded view of the ball chair in the present invention.
Figure 3:
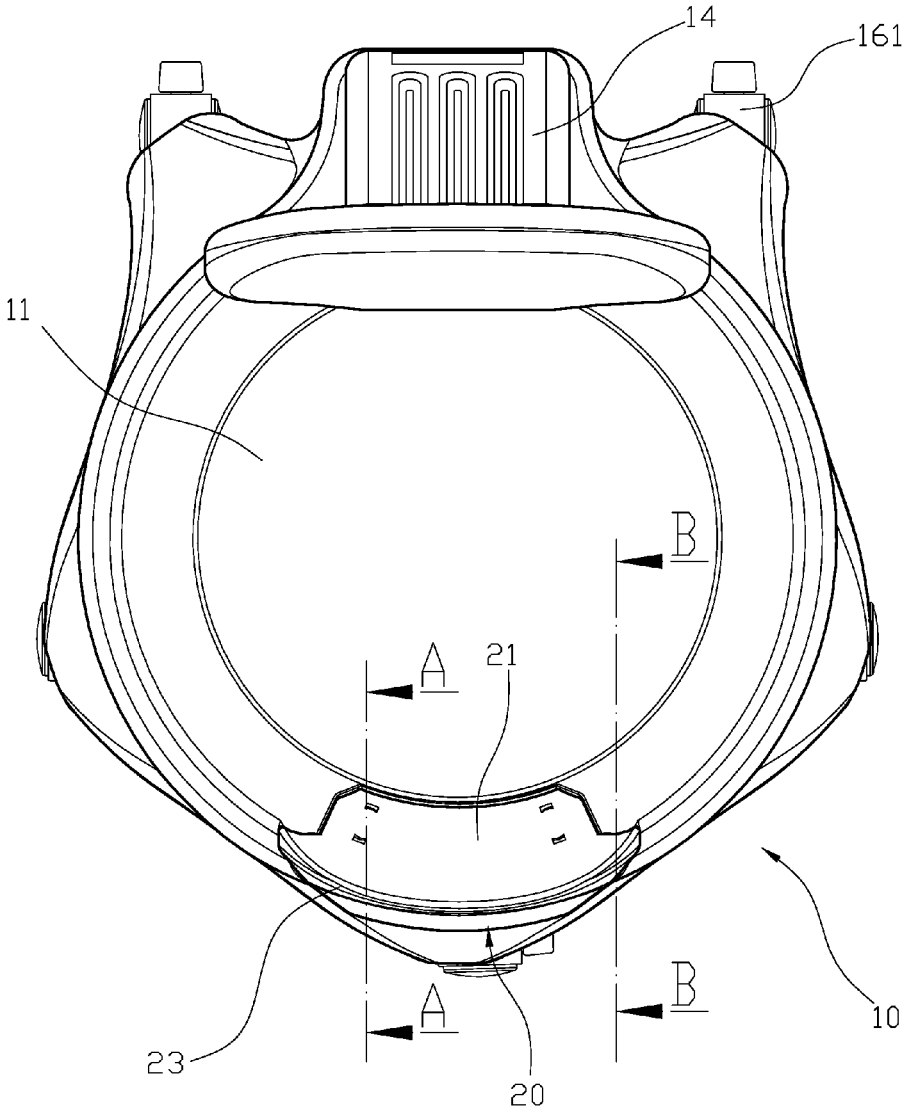
FIG. 3 is a top view of the ball chair in the present invention.
Figure 4:
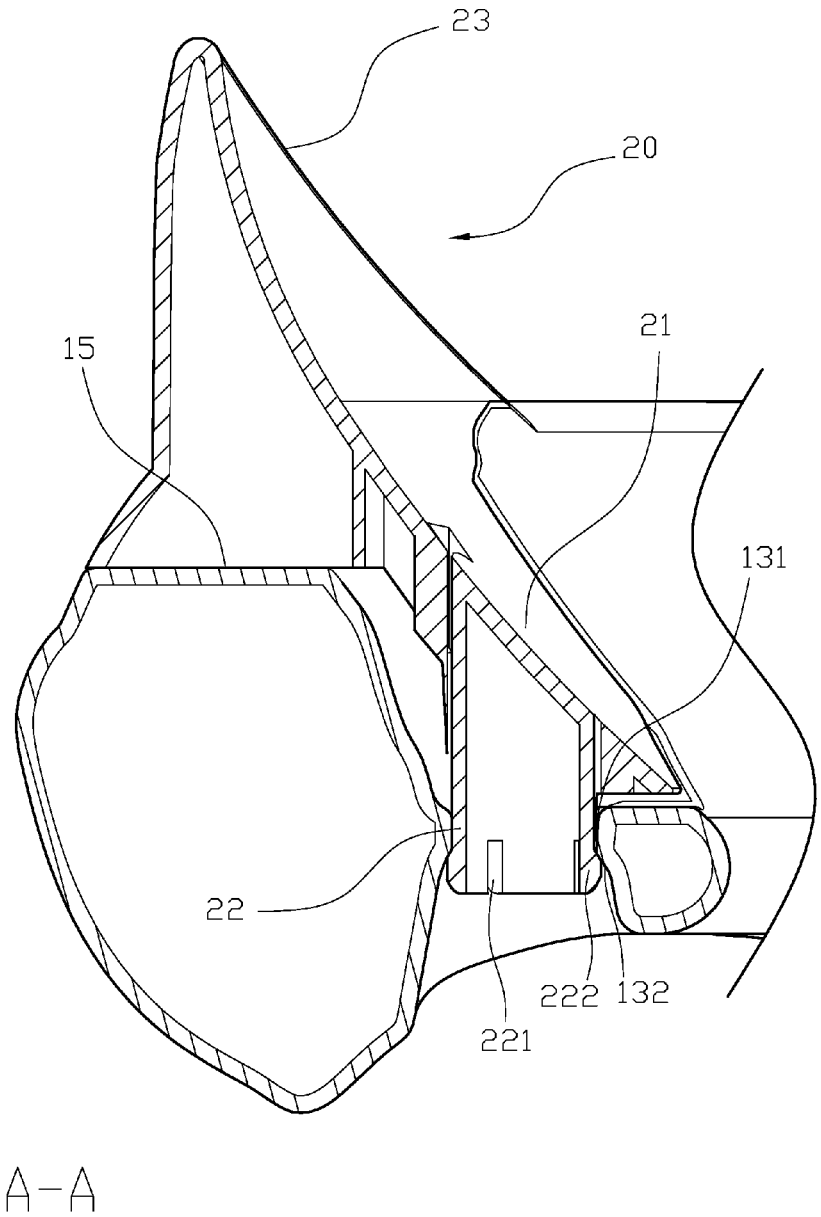
FIG. 4 is a sectional view of FIG. 3 from line A-A in the present invention.
Figure 5:
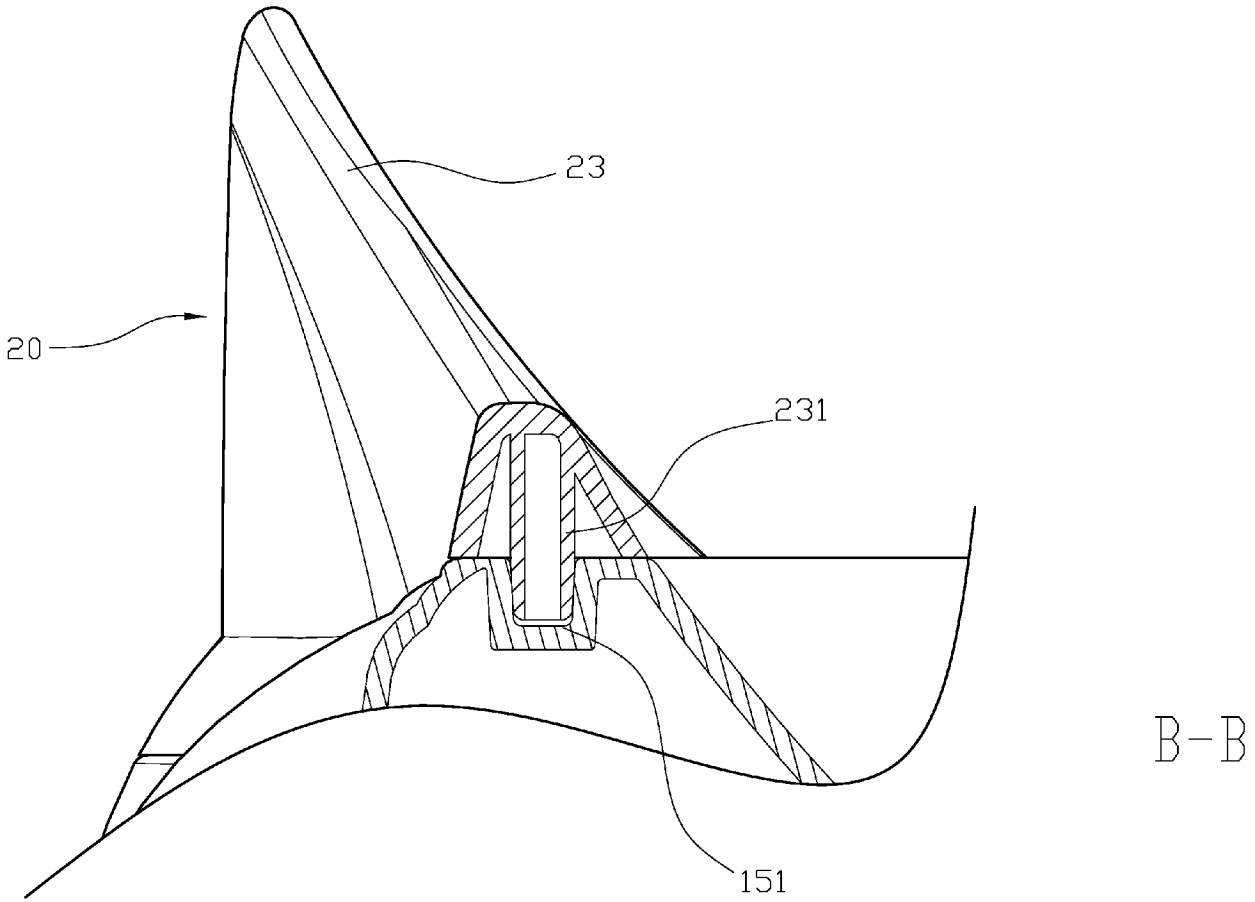
FIG. 5 is a sectional view of FIG. 3 from line B-B in the present invention.
Figure 6:
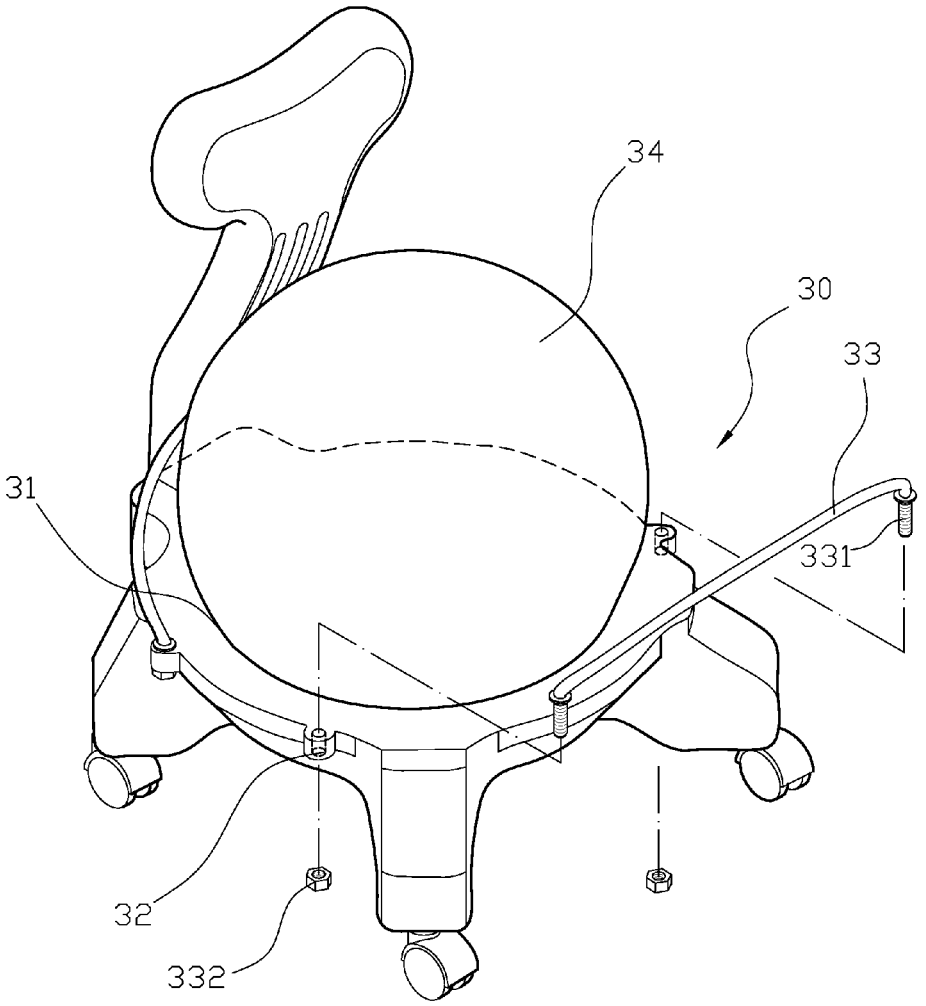
FIG. 6 PRIOR ART
FIG. 6 is a schematic view of a prior art.
Figure 7:
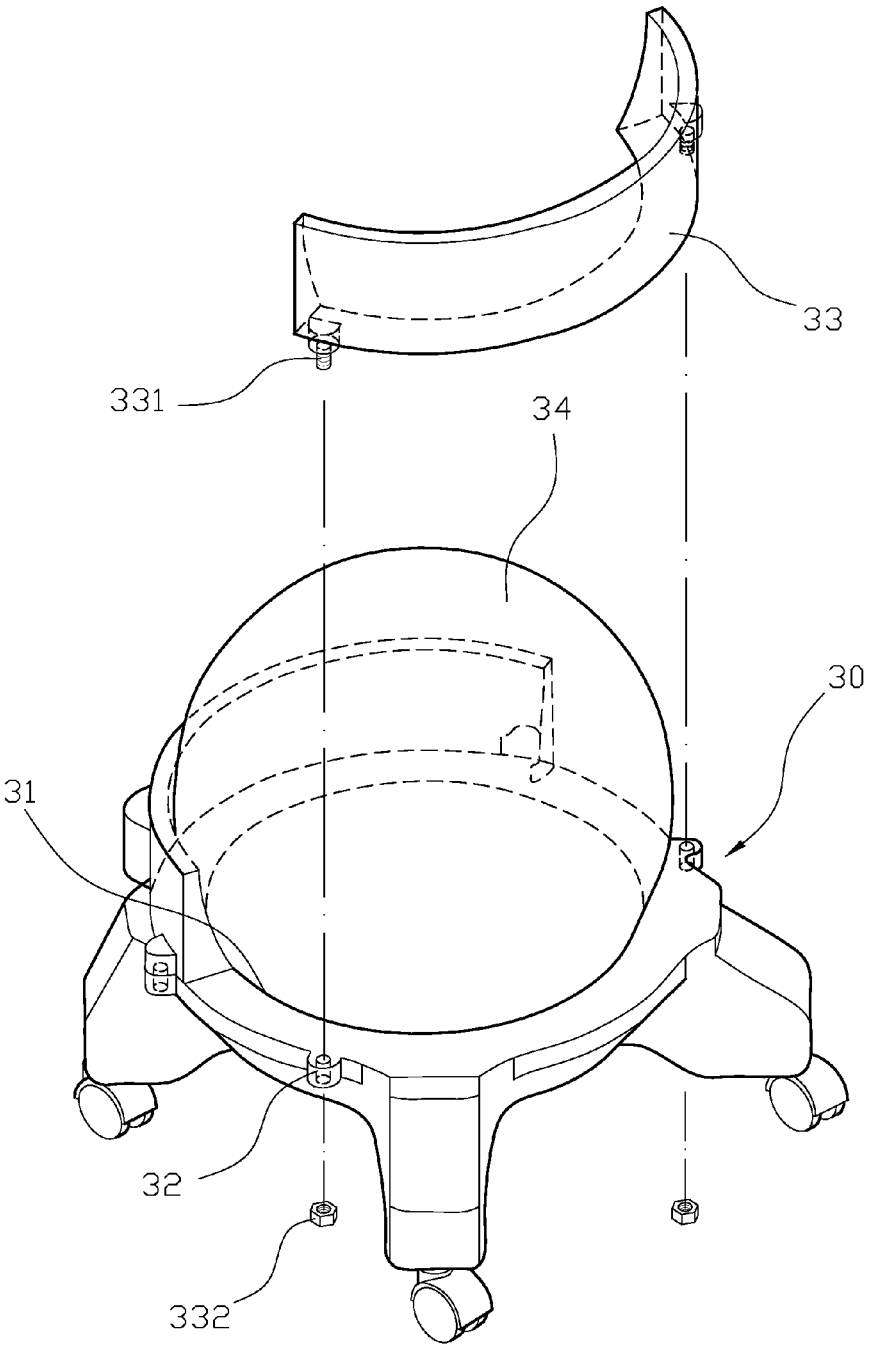
FIG. 7 PRIOR ART
FIG. 7 is a schematic view of another prior art.
Figure 8:
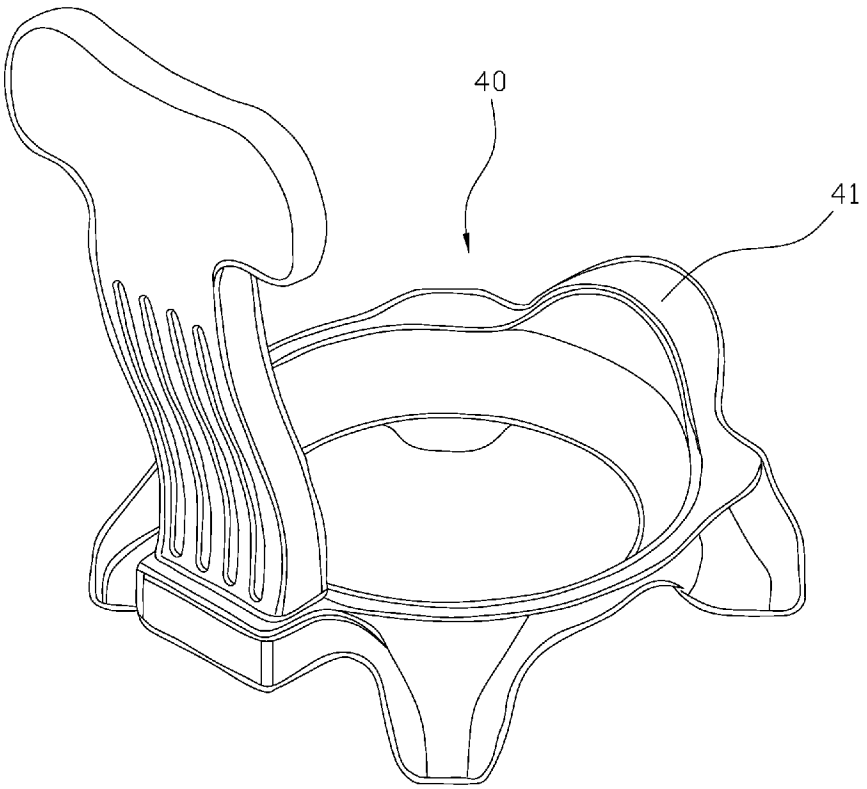
FIG. 8 PRIOR ART
FIG. 8 is a schematic view of a different prior art.

In order to further understand the goal, characteristics and effect of the present invention, a number of embodiments along with the drawings are illustrated as following:

Referring to FIGS. 1 to 5, the present invention provides a ball chair including a chair base 10 and a restricting unit 20. The chair base 10 has a circular receiving space 11 to receive a ball 12. One inner side of the receiving space 11 has a connecting portion 13 and a seatback 14 is disposed on the chair base 10 facing the connecting portion 13. The connecting portion 13 at least has two through holes 131, and an inner wall of each of the through hole 131 expands to form a recessed portion 132, and an engaging groove 133 is formed between two through holes 131. A connecting recessed portion 15 is formed above the connecting portion 13 and a restricting hole 151 is formed on both sides of the connecting recessed portion 15 and the connecting recessed portion 15 has a connecting groove 152. The chair base 10 at least has three legs 16 at a bottom thereof and each leg 16 has a wheel 161. The restricting unit 20 has an arc board 21 and a connecting post 22 conjugating with the connecting portion 13. The connecting post 22 has a plurality of slots 221 and a protruding unit 222. A plurality vertical reinforced ribs 211 are formed at an inner portion of the arc board 21, a restricting board 23 extends from the arc board 21 corresponding to the connecting recessed portion 15, and a bottom portion of the restricting board 23 has a restricting rib 231 on both sides thereof. The restricting unit 20 has an engaging rib 212 and a connecting rib 232 located at a bottom portion of the arc board 21 and the restricting board 23 respectively corresponding to the engaging groove 133 and the connecting groove 152.

When in use, referring to FIGS. 1 to 5, the restricting unit 20 is attached to the connecting portion 13 of the chair base 10 through the arc board 21 and the restricting board 23 engages with the connecting recessed portion 15. The connecting post 22 is inserted into the through hole 131 by pressing the slots 221 of the connecting post 22, and the protruding unit 222 engages with the recessed portion 132, so the restricting rib 231 of the restricting board 23 is configured to insert and engage with the restricting hole 151 of the connecting recessed portion 15, and the engaging rib 212 and the connecting rib 232 located at the bottom portion of the arc board 21 and the restricting board 23 are conjugated with the engaging groove 133 and the connecting groove 152 respectively.

According to the above ball chair structure, the arc board 21 can be aligned with an inner wall of the receiving space 11 and the restricting board 23 is protruding from the upper portion of the receiving space 11, so when the ball 12 is inserted into the receiving space 11, the periphery of the ball 12 can be smoothly attached to the inner wall of the receiving space 11, and the ball 12 can be used to push the arc board 21 of the restricting unit 20 to effectively restrict the restricting unit 20 on the chair base 10. Furthermore, the restricting board 23 and the seatback 14 are used to restrict the ball 12 to increase the stability of the ball 12 on the chair base 10. Thus, when the user is sitting on the ball chair or exercising thereon, the ball is unlikely to fall off from the chair base 10 to increase the safety of the ball chair.

Comparing with conventional ball chairs, the present invention is advantageous because: (i) the connecting portion 13 of the chair base 10 is provided for the restricting unit 20 to restrict the ball 12, and the restricting unit 20 and the connecting portion 13 can be quickly and easily engaged to increase the convenience during the assembling process and prevent the ball 12 from being damaged; (ii) when the restricting unit 20 is attached to the chair base 10, the arc board 21 is attached and aligned with the inner wall of the receiving space 11, so when the ball 12 is inserted into the receiving space 11, the ball 12 can be smoothly attached to the inner wall of the receiving space 11 and can be used to push the arc board 21 of the restricting unit 20 to restrict the restricting unit 20 on the chair base 10 to increase the stability of the ball 12 on the chair base 10, and further increase the safety of the ball chair; and (iii) the restricting unit 20 and the chair base 10 are connected through engagement, so they can be disassembled into smaller pieces which can be easily transported and the transportation costs can be reduced.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ball chair comprising:

a chair base having a circular receiving space to receive a ball and an inner portion of the receiving space having a connecting portion that has at least two through holes; and a restricting unit having an arc board and a connecting post conjugating with the connecting portion, a restricting board extending from the arc board corresponding to the connecting portion, and said restricting board protruding from an upper portion of the receiving space.

2. The ball chair of claim 1, wherein a bottom portion of the chair base has three legs, and each leg has a wheel.

3. The ball chair of claim 1, wherein a seatback is disposed on the chair base facing the connecting portion.

4. The ball chair of claim 1, wherein a connecting recessed portion is formed above the connecting portion to engage with the restricting board.

5. The ball chair of claim 1, wherein a plurality of vertical reinforced ribs are formed at an inner portion of the arc board.

6. The ball chair of claim 1, wherein an engaging groove is formed between said two through holes to engage with an engaging rib located at a bottom portion of the arc board.

* * * * *